US006823657B1

(12) United States Patent
Waschatz et al.

(10) Patent No.: US 6,823,657 B1
(45) Date of Patent: Nov. 30, 2004

(54) REGENERATION OF A $NO_X$ STORAGE CATALYTIC CONVERTER OF AN INTERNAL COMBUSTION ENGINE

(75) Inventors: Uwe Waschatz, Meine (DE); Ulrich-Dieter Standt, Meine (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 09/582,681

(22) PCT Filed: Dec. 10, 1998

(86) PCT No.: PCT/EP98/08061

§ 371 (c)(1),
(2), (4) Date: Aug. 30, 2000

(87) PCT Pub. No.: WO99/33548

PCT Pub. Date: Jul. 8, 1999

(30) Foreign Application Priority Data

Dec. 22, 1997 (DE) ..... 197 58 018

(51) Int. Cl.[7] ..... F01N 3/00

(52) U.S. Cl. ..... 60/274; 60/285; 60/286; 60/295; 123/443

(58) Field of Search ..... 60/274, 285, 286, 60/295, 297; 123/443

(56) References Cited

U.S. PATENT DOCUMENTS 5,657,625 A * 8/1997 Koga et al. ..... 60/274
5,758,493 A * 6/1998 Asik et al. ..... 60/274
5,778,667 A * 7/1998 Kinugasa et al. ..... 60/274
5,974,793 A * 11/1999 Kinugasa et al. ..... 60/285
6,014,859 A * 1/2000 Yoshizaki et al. ..... 60/285
6,119,452 A * 9/2000 Kinugasa et al. ..... 60/285
6,138,453 A * 10/2000 Sawada et al. ..... 60/277
6,244,047 B1 * 6/2001 Brehob et al. ..... 60/295
6,314,935 B2 * 11/2001 Tanaka et al. ..... 123/298

FOREIGN PATENT DOCUMENTS

| | | |
|---|---|---|
| DE | 195 22 165 | 12/1995 |
| DE | 195 43 219 | 12/1996 |
| DE | 196 00 558 | 7/1997 |
| EP | 0 540 280 | 5/1993 |
| EP | 0 560 991 | 9/1993 |
| EP | 0 562 805 | 9/1993 |
| EP | 0 580 389 | 1/1994 |
| EP | 0 625 633 | 11/1994 |

* cited by examiner

*Primary Examiner*—Binh Q. Tran
(74) *Attorney, Agent, or Firm*—Kenyon & Kenyon

(57) ABSTRACT

A method for $NO_x$ and/or $SO_x$ regeneration of an $NO_x$-storage catalytic converter arranged in an exhaust treatment system of an internal combustion engine having more than one cylinder. A mass flux of reducing agents are increased in the exhaust treatment system. A control unit operates the more than one cylinder of the internal combustion engine so that the cylinders are selectively detuned. The control unit can operate a first part of the cylinders under a lean condition where $\lambda>1$ and the control unit can operate a second set of the cylinders under a rich condition where $\lambda<1$.

45 Claims, 1 Drawing Sheet

REGENERATION OF A $NO_x$ STORAGE CATALYTIC CONVERTER OF AN INTERNAL COMBUSTION ENGINE

FIELD OF THE INVENTION

The present invention relates to regenerating an $NO_x$-storage catalytic convertor of an internal combustion engine.

BACKGROUND INFORMATION

To clean the exhaust of an engine having internal combustion of a fuel, the nitrogen oxide produced during combustion must be reduced. In conventional engines controlled to an average λ of 1, this can be achieved with good results by a 3-way catalytic convertor. However, there is presently no such established emission control process in internal combustion engines operated at λ values greater than 1, such as, e.g., lean mix engines, direct-injection spark ignition engines, and diesel engines. In such types of engines, zeolite catalytic convertors (also referred to later as "lean-mix catalytic converters") and $NO_x$-storage catalytic convertors are presently used as methods for treating exhaust gases. The zeolite catalytic convertors are thermally inactivated, which is why they cannot be used in engines for vehicles that must demonstrate a service life in the registration process. Furthermore, these catalytic converters can only use the hydrocarbons in the exhaust for reducing nitrogen oxides, so that only relatively low conversions of nitrogen oxide are attained. These often amount only to 15%, if one disregards the partial reduction of nitrogen oxides to dinitrogen monoxide. The inadequate CO and HC conversions is also a disadvantage of these catalytic convertors, if they have no precious metal. $NO_x$-storage catalytic converters are more promising than the above-mentioned zeolite catalytic converters, since the former use both the hydrocarbons, as well as the hydrogen and CO, in the exhaust as reducing agents. Basically, these are 3-way catalytic convertors having a component for storing $NO_x$. However, the $NO_x$ store or storage element becomes clogged with $NO_x$ after extended lean engine phases, and is, thus, no longer effective. Therefore, in the case of the $NO_x$-storage catalytic converters, it is necessary to periodically remove the stored $NO_x$ from the store, i.e., to reduce the stored $NO_x$.

EP 0 540 280 describes treating exhaust using an exhaust treatment system including a means for storing and releasing $NO_x$, the nitrogen oxides being temporarily stored during lean engine operation and thermally released again by heating the introduced exhaust gases. The released nitrogen oxides are then decomposed under oxidizing conditions by a catalytic converter which decomposes $NO_x$. In particular, the $NO_x$-decomposing catalytic convertor can include a 3-way catalytic converter and/or a zeolite catalytic converter, which is operated at a λ less than or equal to one. It is particularly disadvantageous that this catalytic converter is not sufficiently thermally resistant; and in order to prevent damage, as typically occurs in such catalytic converters under high loads and exhaust temperatures at λ=1, an exhaust-gas switching operation requiring appropriate servo and control units for its operation, is necessary. In addition, the problem of durability is not solved with these parts. Furthermore, the question of operating temperature remains unanswered in the parts of the exhaust treatment system having no exhaust gas flowing through them during the stoichiometric engine operation phases; or in the reverse case, in the parts having no exhaust gas flowing through them during lean operation. In this case, the light-off temperature range of the 3-way catalytic converters is particularly problematic, because dinitrogen monoxide is increasingly formed in this phase through partial reduction of the nitrogen oxides from the engine. Should this range be passed through again and again by periodically cooling of the 3-way catalytic converter, one must expect excessive production of dinitrogen monoxide, which is undesirable because of the greenhouse relevance of this gas.

EP 0 562 805, herein incorporated by reference, describes an exhaust treatment system of an internal combustion engine, in which the exhaust system has two lean $NO_x$ catalytic converters that are arranged in parallel and have exhaust gas alternately flowing through them. In addition, the known arrangement includes a device for changing the space velocity of the exhaust, in order to be able to set an optimum space velocity of the exhaust. Furthermore, the exhaust system has a means of injecting HC directly into the exhaust flue. The service life is also questionable in this case, since zeolite catalytic converters are not thermally resistant, and in particular, do not tolerate rich or stoichiometric exhaust. The service life of the device is also problematic with regard to changing the space velocity of the exhaust switching device. Even if better adapting the space velocities of the exhaust produces an $NO_x$ conversion higher than in typical zeolite catalytic converters, the catalytic converter according to EP 0 562 805 does not reach the magnitude of over 90% required for complying with the new exhaust emission standards. Moreover, the problems of dinitrogen monoxide formation and the HC and CO conversion of these catalytic converters being too low, remain unsolved.

EP 0 580 389 illustrates a process for treating the exhaust of leanly operated engines, which are equipped with an $NO_x$ absorber having an alkali, alkaline-earth, or rare-earth metal base, a 3-way catalytic converter arranged downstream, as well as sensors for detecting the load and the exhaust temperature. In this context, the information from the sensors is used to define the range in which the $NO_x$ absorber is able to store nitrogen oxides. The catalytic converter is regenerated by enrichment for a predefined period. A disadvantage of this known device is the separation of the absorber and the 3-way catalytic converter, since the nitrogen oxides predominantly generated by the engine must initially be oxidized to $NO_2$ in order to be able to be stored in the absorber.

EP 0 560 991 describes a system for treating exhaust of an internal combustion engine, in which the absorber and the catalytic converter are contained in a housing. The nitrogen oxides are stored when the engine is operated leanly, i.e., when the exhaust is lean, and are released when the oxygen concentration in the exhaust is lowered to rich or stoichiometric λ values, so that the released $NO_x$ is reduced by the unburned hydrocarbons and the CO of the exhaust. Switching over from lean to rich or stoichiometric operation is typically accompanied by sudden changes in torque, which are only desirable to the vehicle driver, when they occur during an acceleration phase. These sudden changes in torque are extremely undesirable, if they occur during a constant operation phase. Since the $NO_x$ store is normally emptied during constant operation phases, it is attempted to reduce these sudden changes in torque by adjusting the ignition timing simultaneously to the enrichment.

Furthermore, the presently known $NO_x$-storage catalytic converters are inactivated by sulfur-containing fuel. The material absorbing $NO_x$ in the $NO_x$-storage catalytic converter, especially BaO or $BaCO_3$, reacts with the $SO_2$, which is present in the exhaust and is oxidized to $SO_3$ at the platinum present in the catalytic converter, to form thermally stable sulfates that can be decomposed at a temperature lying above the decomposition temperature of the nitrates formed from the store material and the $NO_2$. In order to decompose these sulfates, a sulfate regeneration program is therefore executed from time to time, as a function of the sulfur content of the fuel being used; the temperature being increased to approximately 600–700° C. by enriching the exhaust, so that the sulfates decompose. However, the disadvantage of the enrichment is that this normally correlates to an increased power output of the engine, so that carrying out desulfation finally causes the vehicle to accelerate unintentionally.

SUMMARY

The present invention provides a device and/or a method for treating exhaust of an internal combustion engine, which reduces the $NO_x$ concentration of the exhaust and/or the sulfate content of the $NO_x$ store without effecting a sudden change in torque or an increased power output.

The present invention provides a method for $No_x$ and/or $So_x$ regeneration of an $No_x$-storage catalytic converter, which is arranged in an exhaust treatment system of an internal combustion engine having more than one cylinder; a mass flux of reducing agents (HC, CO, $H_2$) being increased in the exhaust in order to regenerate the $NO_x$-storage catalytic converter, wherein by means of a control unit, a part of the cylinders is operated under lean conditions ($\lambda>1$) and another part of the cylinders is operated under rich conditions ($\lambda<1$) (cylinder-selective detuning); however, the average over all of the cylinders is $\lambda \geqq 1$.

Another embodiment of the present invention provides a method wherein a part of the cylinders is operated during the regeneration at $\lambda \leqq 0.95$, and more preferably at $\lambda \leqq 0.85$. Another embodiment of the present invention provides a method as recited in either embodiment above wherein the cylinders are selectively detuned during a constant operating phase without load alteration.

Another embodiment of the present invention provides a method as recited in any of the embodiments above, wherein half of, or a number close to half of, the cylinders is enriched.

Another embodiment of the present invention provides a method as recited in any of the embodiments above, wherein the control unit selectively detunes the cylinders at idle, in deceleration, and/or in response to an engine load $\leqq 25\%$ of the maximum engine load.

Another embodiment of the present invention provides a device implementing any of the methods of the above-described embodiments.

DETAILED DESCRIPTION

Figure 1:
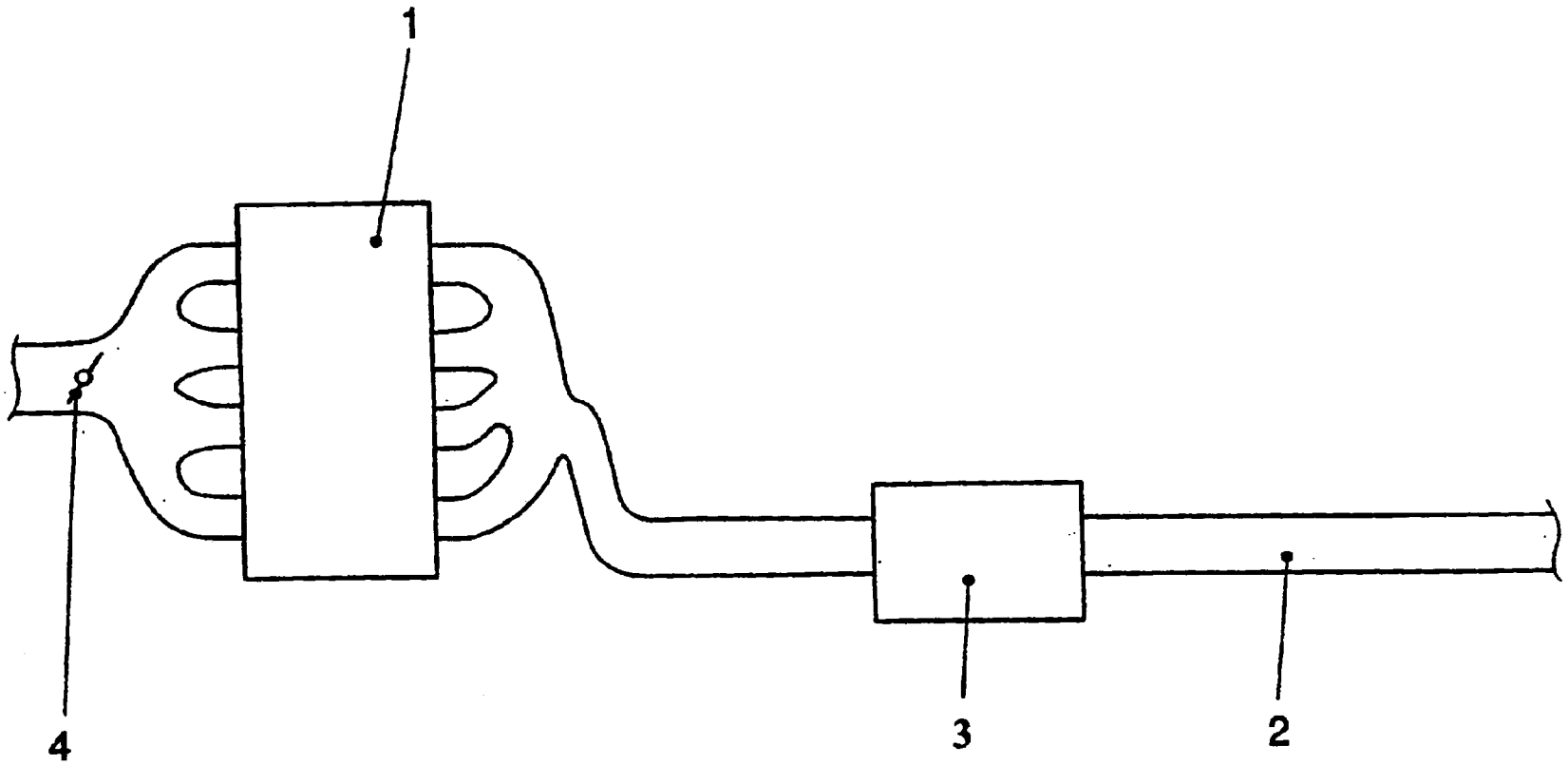
FIG. 1 shows an embodiment of the present invention wherein an engine has more than one cylinder.

The present invention is used to detoxify exhaust gases of an internal combustion engine, the detoxification especially being a reduction of the nitrogen oxides. The present invention can also be used to temporarily store $SO_x$, as can be the case with exhaust treatment devices of leanly operated internal combustion engines, depending on the existing sulfur content of the fuel. $NO_x$ is normally stored by storing $NO_2$(for example, as nitrate); alkaline earth oxides and/or carbonates (e.g. BaO) being especially suitable. Such substances are also in a position to store $SO_x$, especially in the form of $SO_3$. Since desulfation requires higher temperatures than denitrification, an $SO_x$ store can be put in front of an $NO_x$ store, as desired, through which on one hand, the $SO_x$ store is subjected to higher temperatures than the $NO_x$ store, and on the other hand, the $NO_x$ store is not poisoned by $SO_x$. During regeneration, i.e. operation of the store with an exhaust that has a $\lambda=1$, or is rich, $SO_x$ and $NO_x$ are released again, the $NO_x$ being catalytically converted by existing HC and/or CO. However, the $SO_x$ is either released as is, or as a variety of different compounds after reacting with CO and/or HC, no $SO_x$ being stored in the downstream $NO_x$ store under the existing regeneration conditions.

Unless otherwise indicated, the following will principally focus on only an $NO_x$ store; however, these remarks are equally valid for an $SO_x$ store and for a combination of these stores.

The exhaust treatment device of an internal combustion engine having more than one cylinder preferably includes an $NO_x$-storage catalytic converter arranged downstream from the internal combustion engine, the exhaust flowing continuously into the $NO_x$ store of the catalytic converter in such a manner, that the $NO_x$ is absorbed in the $NO_x$ store as soon as the machine is leanly operated, and the $NO_x$ is released as soon as the oxygen concentration of the exhaust is lowered, the engine being operated during the $NO_x$ release phase with a gross A value somewhat above the stoichiometric ratio of $\lambda=1$.

The $\lambda$ value is preferably $\geqq 1.01$ during the $NO_x$ release phase. In this case, one can switch back and forth between lean engine operation and engine operation slightly above the stoichiometric exhaust value, the switchover times being a function of the duration of the lean operation.

To preferably generate the nearly stoichiometric exhaust stream having a gross $\lambda$ value of $\geqq 1$, one part of the cylinders is selectively and individually enriched, while the other part of the cylinders continues to be leanly operated. This selectively detunes the individual cylinders with regard to their $\lambda$ values, preferably during a constant operating phase without load alteration. Advantageously, half, or a number close to half, of the cylinders is individually enriched. In addition, the enriched cylinders are especially enriched to $\lambda \leqq 0.9$, and particularly advantageously enriched to $\lambda \leqq 0.85$. In comparison with operating near $\lambda=1$, this extreme enrichment brings about a smaller torque fluctuation, since the power output in response to sharp enrichment is lower than that of $\lambda=1$. This requires a smaller correction by the throttle valve and/or via the entire amount of fuel injected. In this connection, the enrichment can be advantageously done up to $\lambda=0.7$ and less. The result is, that the present invention can be used particularly in spark ignition engines, and especially advantageously in direct injection engines. In addition, the present invention eliminates having to throttle the cylinders individually, so that the portion of mechanical control elements is not increased.

For example, in a 4-cylinder motor, two cylinders can be enriched, and two cylinders can continue to be leanly operated. The same applies to engines having a different number of cylinders. In this case, being able to divide the number of cylinders into two is not essential, but rather other conditions can be selected in accordance with the requirements; the conditions also being modifiable during operation.

The selective detuning of the individual cylinders with respect to $\lambda$ value can be undertaken by a control unit.

In summary, the exhaust treatment method described here effectively converts not only nitrogen oxides, but also all of the exhaust components, in that the engine is enriched or operated at a $\lambda=1$ during non-steady-state engine operating phases attributable to driving behavior, whereby the $NO_x$ store is emptied again; and during long-term, steady-state operation, the engine switches back and forth between lean and nearly stoichiometric operation at a $\lambda$ slightly greater than 1. This is brought about in the engine by selectively enriching a part of the cylinders in the engine and allowing the other part of the cylinders to continue running leanly, in order to produce the nearly stoichiometric exhaust. In this case, only small torque fluctuations occur, and the power output of the engine is not increased. Therefore, one can dispense with additional measures, such as excessively adjusting the ignition timing. Advantageously, the method according to the present invention does not produce more dinitrogen monoxide than known 3-way catalytic converters. Furthermore, the device of the present invention desulfates the $NO_x$ store by appropriately and selectively detuning the individual cylinders with regard to $\lambda$ value.

The following table displays measured values of the gross nitrogen oxide conversion $\eta NO_x$ of an engine having lean and regeneration operation in a continuous sequence of lean operation and subsequent regeneration operation; this is shown once for a rich $\lambda$ value of 0.85 and once for a $\lambda$ value of 1.01, which is slightly above the stoichiometric value. It can be gathered from the table, that the regeneration method of the present invention attains a gross conversion, which is even slightly higher than that of the rich exhaust of the known methods, even when the regeneration method of the present invention is working slightly above the stoichiometric $\lambda$ value.

TABLE 1

| $\eta_{NOx}$ [%] | Regeneration Å |
|---|---|
| 87 | 0.85 |
| 88 | 1.01 |

A preferred embodiment is explained below using FIG. 1, which schematically represents how the exhaust system is arranged on an internal combustion engine.

In FIG. 1, reference numeral 1 indicates an engine having more than one cylinder, such as a lean-mix spark ignition engine, a direct-injection spark ignition engine, or a diesel engine, with an exhaust treatment system arranged downstream, which has an $NO_x$-storage catalytic converter 3. By selectively detuning the $\lambda$ values of a part of the individual cylinders (not shown) and allowing the other part of the cylinders to continue operating leanly, a gross $\lambda$ value, that is, a $\lambda$ value averaged over all cylinders, is set slightly over the stoichiometric value of the exhaust, in order to regenerate the $NO_x$, store 3; and in this manner, the $NO_x$ store is regenerated and desulfated.

What is claimed is:

1. A method for $NO_x$ and/or $SO_x$ regeneration of an $NO_x$-storage catalytic converter arranged in an exhaust treatment system of an internal combustion engine having more than one cylinder, exhaust gas from each of the more than one cylinder feeding into the $NO_x$-storage catalytic converter, comprising:

increasing a mass flux of reducing agent in the exhaust treatment system;

operating a first set of the more than one cylinder under a lean condition where $\lambda>1$;

selectively detuning by operating a second set of the more than one cylinder under a rich condition where $\lambda<1$ so that an average over all of the cylinders is $\lambda\geqq1$.

2. The method as recited in claim 1 wherein an average of $\lambda$ at time t is equal to or greater than 1.

3. The method as recited in claim 2 wherein the mass flux of reducing agents is selected from the group consisting of HC, CO, and $H_2$.

4. The method as recited in claim 3 wherein the second set of cylinders is operated during the regeneration at $\lambda\leqq0.95$.

5. The method as recited in claim 3 wherein the second set of cylinders is operated during the regeneration at $\lambda\leqq0.85$.

6. The method as recited in claim 2 wherein the more than one cylinders are selectively detuned during a constant operating phase without load alteration.

7. The method as recited in claim 3 wherein the more than one cylinders are selectively detuned during a constant operating phase without load alteration.

8. The method as recited in claim 2 wherein about half of the more than one cylinder is enriched.

9. The method as recited in claim 3 wherein about half of the more than one cylinder is enriched.

10. The method as recited in claim 4 wherein about half of the more than one cylinder is enriched.

11. The method as recited in claim 5 wherein about half of the more than one cylinder is enriched.

12. The method as recited in claim 6 wherein about half of the more than one cylinder is enriched.

13. The method as recited in claim 7 wherein about half of the more than one cylinder is enriched.

14. The method as recited in claim 2 wherein the control unit selectively detunes the more than one cylinder at idle, in deceleration, and/or in response to an engine load $\leqq25\%$ of a defined maximum engine load.

15. The method as recited in claim 3 wherein the control unit selectively detunes the more than one cylinder at idle, in deceleration, and/or in response to an engine load $\leqq25\%$ of a defined maximum engine load.

16. The method as recited in claim 4 wherein the control unit selectively detunes the more than one cylinder at idle, in deceleration, and/or in response to an engine load $\leqq$25% of a defined maximum engine load.

17. The method as recited in claim 5 wherein the control unit selectively detunes the more than one cylinder at idle, in deceleration, and/or in response to an engine load $\leqq25\%$ of a defined maximum engine load.

18. The method as recited in claim 6 wherein the control unit selectively detunes the more than one cylinder at idle, in deceleration, and/or in response to an engine load $\leqq25\%$ of a defined maximum engine load.

19. The method as recited in claim 7 wherein the control unit selectively detunes the more than one cylinder at idle, in deceleration, and/or in response to an engine load $\leqq25\%$ of a defined maximum engine load.

20. The method as recited in claim 8 wherein the control unit selectively detunes the more than one cylinder at idle, in deceleration, and/or in response to an engine load $\leqq25\%$ of a defined maximum engine load.

21. The method as recited in claim 9 wherein the control unit selectively detunes the more than one cylinder at idle, in deceleration, and/or in response to an engine load $\leqq25\%$ of a defined maximum engine load.

22. The method as recited in claim 10 wherein the control unit selectively detunes the more than one cylinder at idle, in deceleration, and/or in response to an engine load $\leqq25\%$ of a defined maximum engine load.

23. The method as recited in claim 11 wherein the control unit selectively detunes the more than one cylinder at idle, in deceleration, and/or in response to an engine load $\leqq25\%$ of a defined maximum engine load.

24. The method as recited in claim 12 wherein the control unit selectively detunes the more than one cylinder at idle, in deceleration, and/or in response to an engine load ≦25% of a defined maximum engine load.

25. The method as recited in claim 13 wherein the control unit selectively detunes the more than one cylinder at idle, in deceleration, and/or in response to an engine load ≦25% of a defined maximum engine load.

26. A device for $NO_x$ and/or $SO_x$ regeneration of an $NO_x$-storage catalytic converter, which is arranged in an exhaust treatment system of an internal combustion engine having more than one cylinder, and is loaded with an increased mass flux of reducing agents in the exhaust, for regeneration, wherein the device includes a control unit, by means of which a first set of more than one of the cylinders is operated under lean conditions where $\lambda>1$, a second set of more than one of the cylinders is operated under rich conditions where $\lambda<1$ for detuning during regeneration so that the average $\lambda$ over time t is equal to or greater than 1, wherein each of the more than one cylinder is arranged to feed exhaust gas to the $NO_x$-storage catalytic converter.

27. The method as recited in claim 26 wherein the mass flux of reducing agents are selected from the group consisting of HC, CO and $H_2$.

28. The device as recited in claim 26 wherein the internal combustion engine is a spark ignition engine.

29. The device as recited in claim 26 wherein the internal combustion engine is a direct injection engine.

30. A method for regeneration of at least one of $NO_x$ and $SO_x$ of an $NO_x$-storage catalytic converter arranged in an exhaust treatment system of an internal combustion engine including more than one cylinder, comprising the steps of:

increasing a mass flux of reducing agents in the exhaust to regenerate the $NO_x$-storage catalytic converter; and operating more than one first cylinder under lean conditions and more than one second cylinder under rich conditions by a control unit so that an average of all of the cylinders is $\lambda \geqq 1$;

wherein exhaust gas from each of the more than one cylinder feeds into the $NO_x$-storage catalytic converter.

31. The method according to claim 30, wherein at least one cylinder is operated during the regeneration at $\lambda \leqq 0.95$.

32. The method according to claim 30, wherein at least one cylinder is operated during the regeneration at $\lambda \leqq 0.85$.

33. The method according to claim 31, further comprising the step of selectively detuning the cylinders during a constant operating phase without load alteration.

34. The method according to claim 30, wherein the more than one second cylinder includes approximately one half of the cylinders.

35. The method according to claim 30, further comprising the step of detuning the cylinders by the control unit at least one of at idle, in deceleration and in response to an engine load ≦25% of a maximum engine load.

36. The method according to claim 30, wherein the reducing agents include at least one of HC, CO and $H_2$.

37. A device configured for at least one of $NO_x$ and $SO_x$ regeneration of an $NO_x$-storage catalytic converter arranged in an exhaust treatment system of an internal combustion engine including more than one cylinder and loaded with an increased mass of flux reducing agents in the exhaust for regeneration, comprising:

a control unit configured to operate more than one first cylinder under lean conditions and more than one second cylinder under rich conditions during regeneration so that an average of all of the cylinders is $\lambda \geqq 1$, wherein each of the more than one cylinder is arranged to feed exhaust gas to the $NO_x$-storage catalytic converter.

38. The device according to claim 37, wherein the internal combustion engine includes a spark ignition engine.

39. The device according to claim 37, wherein the internal combustion engine includes a direct injection engine.

40. The device according to claim 37, wherein the reducing agents include at least one of HC, CO and $H_2$.

41. The method according to claim 1, wherein the mass flux of reducing agents are increased by operating the second set of cylinders under rich conditions where $\lambda<1$ and exhaust from the first set of cylinders and the second set of cylinders are combined and passed through the $NO_x$-storage catalytic converter along with the mass flux of reducing agents as produced by the second set of cylinders.

42. The method according to claim 26, wherein the mass flux of reducing agents increased by operating the second set of the cylinders under rich conditions where $\lambda<1$, exhaust from the first set and the second set of the cylinders are combined and pass to the $NO_x$-storage catalytic converter along with the mass flux of reducing agents as produced by the another part of the cylinders.

43. The method according to claim 30, wherein the mass flux of reducing agents is increased by the more than one second cylinder under rich conditions where $\lambda<1$ and exhaust from the more than one first cylinder and the more than one second cylinder are combined and pass to the $NO_x$-storage catalytic converter along with the mass flux of reducing agents as produced by the at least one second cylinder.

44. The method according to claim 37, wherein the mass flux of reducing agents increased by the more than one second cylinder under rich conditions where $\lambda<1$, exhaust from the more than one first cylinder and the more than one second cylinder are combined and pass to the $NO_x$-storage catalytic converter along with the mass flux of reducing agents as produced by the at least one second cylinder.

45. A method for $NO_x$ and/or $SO_x$ regeneration of an $NO_x$-storage catalytic converter arranged in an exhaust treatment system of an internal combustion engine having more than one cylinder, comprising:

(a) increasing a mass flux of reducing agents by maintaining $\lambda<1$ in at least one of a second cylinder and a second set of cylinders while maintaining an average over all cylinders of $\lambda \geqq 1$;

(b) combining exhaust streams from all of the cylinders to produce a combined stream, an exhaust stream from the one of a second cylinder and a second set of cylinders including the mass flux of reducing agents as produced in step (a); and (c) passing the combined stream through the $NO_x$-storage catalytic converter.

* * * * *

UNITED STATES PATENT AND TRADEMARK OFFICE

CERTIFICATE OF CORRECTION

PATENT NO. : 6,823,657 B1
DATED : November 30, 2004
INVENTOR(S) : Waschatz et al.

It is certified that error appears in the above-identified patent and that said Letters Patent is hereby corrected as shown below:

Column 5,
Line 34, change "Å" to -- λ --

Signed and Sealed this

Twenty-second Day of March, 2005

JON W. DUDAS
*Director of the United States Patent and Trademark Office*